US005301630A

United States Patent [19]

Genovese et al.

[11] Patent Number: 5,301,630

[45] Date of Patent: Apr. 12, 1994

[54] INFLATABLE RESCUE RAMP

[75] Inventors: David E. Genovese, Peninsula, Ohio; John F. Ryan, III, Houston, Tex.

[73] Assignee: SMR Technologies, Inc., Sharon Center, Ohio

[21] Appl. No.: 16,144

[22] Filed: Feb. 5, 1993

[51] Int. Cl.[5] ..... B63B 23/00

[52] U.S. Cl. ..... 114/375; 441/80; 182/48; 244/905

[58] Field of Search ..... 441/39, 82, 83, 84, 441/80; 114/375; 244/905; 182/48

[56] References Cited

U.S. PATENT DOCUMENTS

| | | | |
|---|---|---|---|
| 1,128,072 | 2/1915 | Steinmetz . | |
| 2,896,564 | 7/1959 | Wright | 114/262 |
| 2,955,299 | 10/1960 | Ingram, Jr. . | |
| 3,606,939 | 9/1971 | Summer et al. | 244/905 |
| 3,621,383 | 11/1971 | Rush | 244/905 |
| 3,712,417 | 1/1973 | Chacko et al. | 244/905 |
| 3,891,053 | 6/1975 | Burton | 182/97 |
| 4,031,583 | 6/1977 | Phillips, II . | |
| 4,332,049 | 6/1982 | Fisher | 244/905 |
| 4,434,870 | 3/1984 | Fisher | 244/905 |
| 4,989,691 | 2/1991 | Wilkerson et al. | 182/70 |

OTHER PUBLICATIONS

Markus Lifenet advertisement, Markus Lifenet Ltd., Sweden, undated.

*Primary Examiner*—Jesus D. Sotelo

*Attorney, Agent, or Firm*—Renner, Kenner, Greive, Bobak, Taylor & Weber

[57] ABSTRACT

A rescue ramp (10) for use by a watercraft (11) includes a laterally extending first inflatable tube member (14) attachable to the watercraft (11). Second spaced inflatable tube members (15) are connected at one end to and extend longitudinally from the ends of the first tube member (14). A third inflatable tube member (16) is connected between the second tube members (15) near the other end thereof and is adapted to be positioned in the water. A ramp (17) is connected to the first and second tube members (14, 15) so that when the rescue ramp (10) is inflated and attached to the watercraft (11), a person may traverse from the water to the watercraft (11) or from the watercraft (11) to the water. The first tube member (14) is attached to the watercraft (11) by means of a girt bar (23) releasably mounted on the watercraft (11). The girt bar (23) is connected to a first flap (26) which is detachably connected to a second flap (20) attached to the first tube member (14).

20 Claims, 3 Drawing Sheets

INFLATABLE RESCUE RAMP

TECHNICAL FIELD

This invention relates to an inflatable rescue ramp which may be carried in an uninflated, stowed condition by a rescue craft or other watercraft. More particularly, this invention relates to a rescue ramp which, after being attached to the watercraft and inflated, extends into the water so that a person stranded in the water can move up the ramp and into the watercraft or a person from the watercraft can move down the ramp to assist a person in the water, as necessary.

BACKGROUND ART

The rescuing of people stranded in a body of water, particularly turbulent waters encountered in the oceans of the world, is not a simple task. In many environments, such as at off-shore drilling rigs, motorized boats are held by davits to be deployed in the event of an emergency, such as an explosion at the site, which might cause many people to be stranded in the water. Upon such a disaster, it is usually not difficult for the rescue craft to arrive at the location of the stranded person or persons, but rather the problem is boarding the person into the craft. Such a procedure is compounded not only if the person is unconscious or injured, but also if turbulent water is prevalent.

Present known devices of rescuing a person from the sea are not satisfactory for all encountered circumstances. One of the simplest known devices is a rope-like ladder which is attached to the boat at its hatch or portal and merely thrown in the water so that the person to be rescued might climb into the boat. While such may be satisfactory in calm seas, in turbulent situations it is not only difficult to climb the undulating ladder, but also it is highly likely that the person could be injured, as by striking his head on the gunnel or ledge below the hatch. Moreover, the ladder is totally useless if the person to be rescued is injured or unconscious. In such situations, the rescue boat must be manned with several people, some of whom must traverse down the ladder to assist the person to and up the ladder, while others in the craft assist to pull the person on board, while all the time trying to avoid contact with the undulating gunnel.

Another prior art device which has been utilized is a net-like structure which is thrown toward the person to be rescued. If conscious, he may then either hold onto or lay on the net while being pulled into the craft. Such a device suffers from the same problems as does the aforementioned ladder and is simply not a convenient and safe manner in which to rescue the panicked person.

A variety of the net-like structure just described involves a slat-like runner which is thrown into the water. In the operation of this device, the person is positioned on the structure and essentially rolled up into the craft. However, it is almost mandatory that a person from the craft be in the water to utilize this system of rescue, and in addition, at least two people in the craft must be employed to pull the person into the craft.

Thus, the need exists for a system which will allow the conscious person to easily enter the rescue craft on his own power, and a system which accommodates the facile assistance of an unconscious or injured person into the craft.

DISCLOSURE OF THE INVENTION

It is thus a primary object of the present invention to provide an inflatable rescue ramp which is attachable to a rescue craft and which permits a conscious person stranded in the water to readily climb the ramp into the craft without injury.

It is another object of the present invention to provide a rescue ramp, as above, which can also be utilized to easily transport an unconscious or injured person from the water onto the craft.

It is a further object of the present invention to provide a rescue ramp, as above, which is operable in turbulent water without the risk of injury to the stranded person as he enters the craft.

It is an additional object of the present invention to provide a rescue ramp, as above, which when not in use can be stowed in a small area within the rescue craft.

It is yet another object of the present invention to provide a rescue ramp, as above, which can be attached to another rescue craft so that people can traverse from one rescue craft to another.

It is a still further object of the present invention to provide a rescue ramp, as above, which can be readily detached from the rescue craft and converted into an inflated buoyancy platform.

These and other objects of the present invention, as well as the advantages thereof over existing prior art forms, which will become apparent from the description to follow, are accomplished by the improvements hereinafter described and claimed.

In general, a rescue ramp for a watercraft made in accordance with the concepts of the present invention includes a laterally extending first tube member which can be at least temporarily attached to the watercraft. One end of second spaced inflatable tube members are connected to the first tube member and extend generally longitudinally away from the first tube member. A third inflatable tube member is connected between the second tube members near the other end thereof and is adapted to be positioned in the water when the first tube member is connected to the watercraft. A ramp is connected to the first and second tube members so that a person may traverse from the water to the watercraft or from the watercraft to the water.

A preferred exemplary inflatable rescue ramp incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
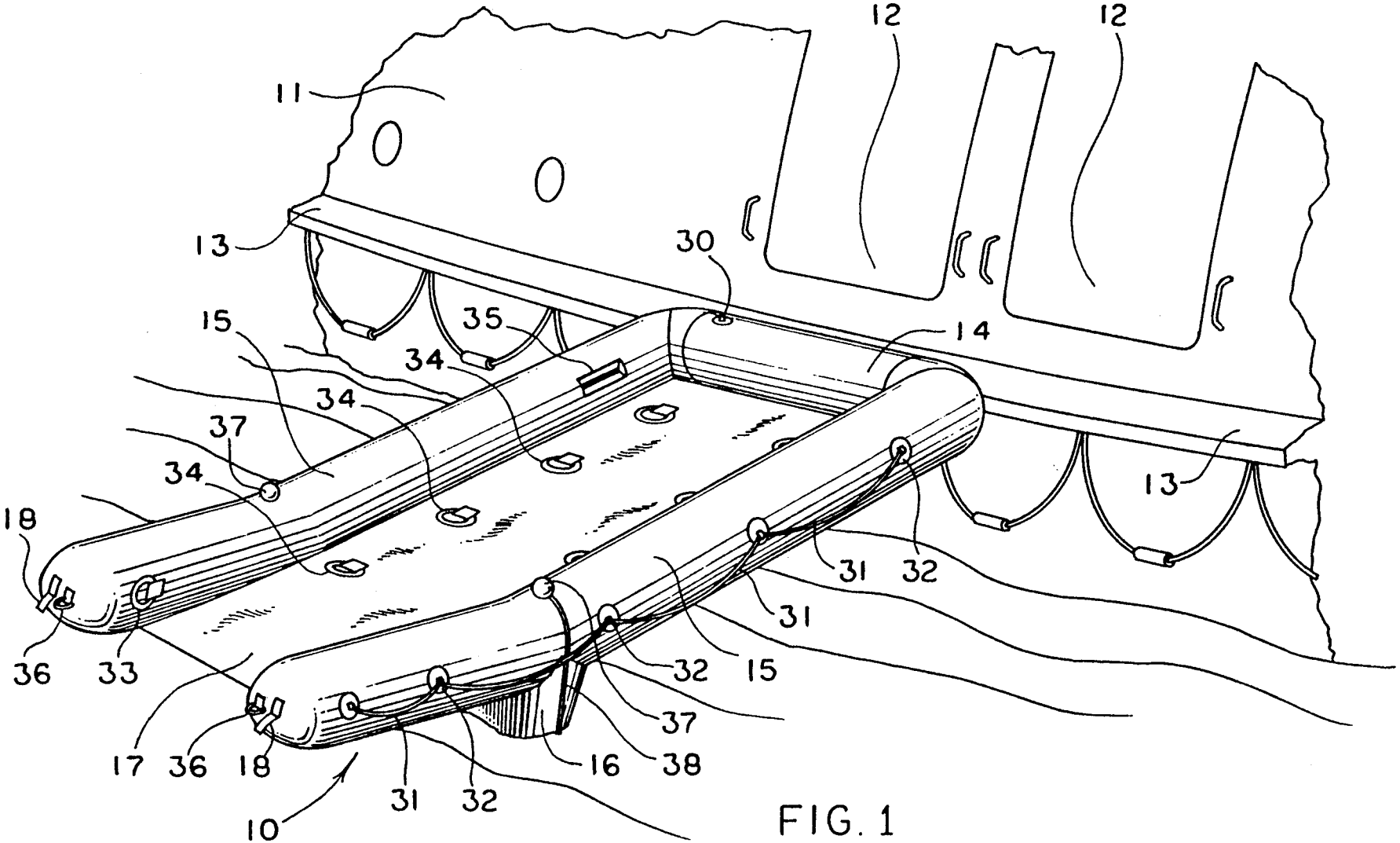
FIG. 1 is a somewhat schematic fragmented perspective view of an inflated rescue ramp according to the concepts of the present invention shown attached to a rescue craft and in the water.

A rescue ramp made in accordance with the concepts of the present invention is generally indicated by the numeral 10 and shown in FIG. 1 as being attached to a rescue craft 11. Craft 11 can be any type of water navigating vessel, with the craft 11 shown having the typical hatches 12 and gunnel or shelf 13 to which ramp 10 can be attached, as will hereinafter be described.

Ramp 10 includes a plurality of interconnected inflatable tubes, now to be described, which are preferably made of a sturdy urethane coated square woven nylon fabric and of a size of about sixteen inches in diameter. Thus, ramp 10 includes a header tube 14 interconnected at its ends with generally parallel side tubes 15 thereby forming, with tube 14, a generally U-shaped plan profile for ramp 10. Side tubes 15 are preferably spaced about three feet apart. A lower cross tube 16 extends between and below side tubes 15 and not only serves to stabilize tubes 15, maintaining them in their intended parallel disposition, but also serves as the flotation member for ramp 10. Thus, as shown in FIG. 1, with ramp 10 in use, cross tube 16 is floating in the water.

A ramp fabric 17 tautly extends between side tubes 15, being attached thereto at the bottom thereof, and is likewise attached to the bottom of header tube 14 to form a ramp walk surface. The ramp fabric 17 can be of any urethane coated material capable of holding the weight preferably of up to three people and could, if desired, also include tube members spaced along the fabric. When rescue ramp 10 is in the water, ramp fabric 17 is preferred to be at an angle of twelve degrees to seventeen degrees, or at least below the recognized angle of twenty-two degrees considered suitable for walking. Thus, ramp fabric 17 is intended to be walked upon as a person, stranded in the water, utilizes rescue ramp 10 to board craft 11 or, as necessary, for a person to traverse down from craft 11 to get into the water.

Figure 2:
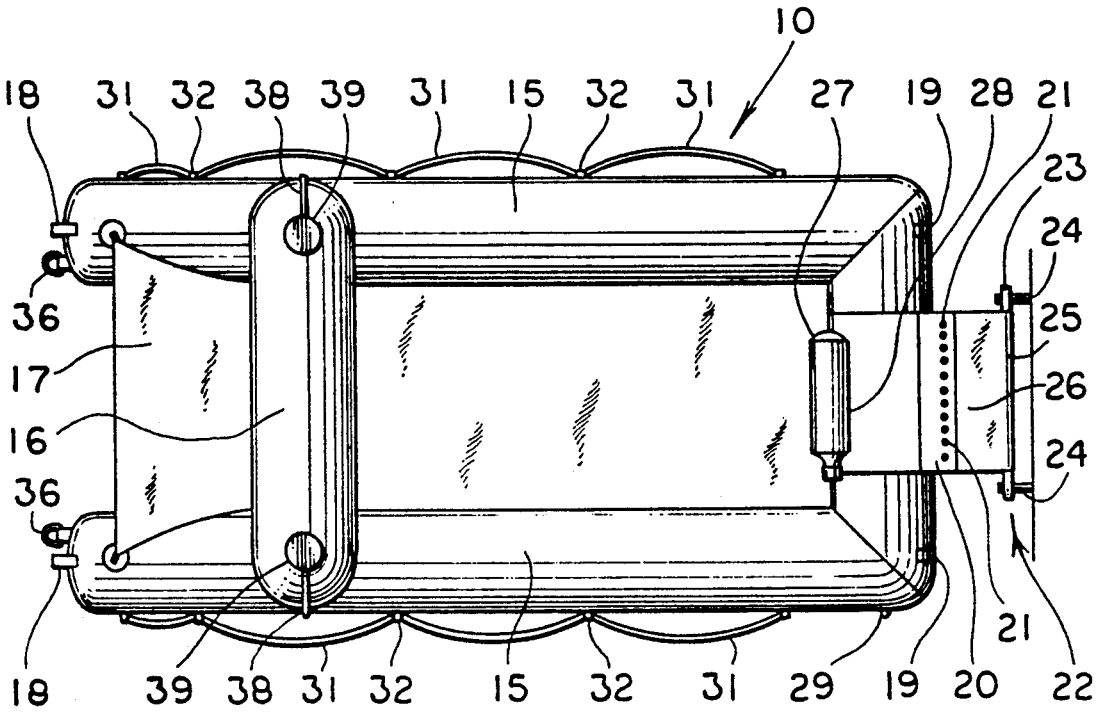
FIG. 2 is a bottom plan view of the rescue ramp shown in FIG. 1.
Figure 3:
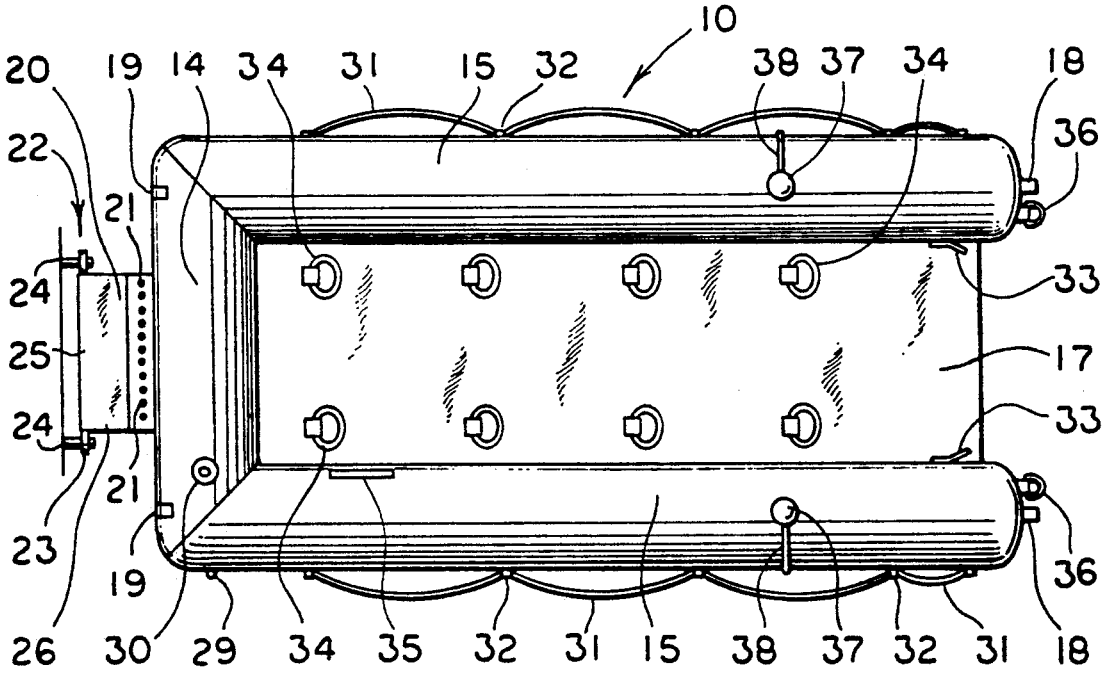
FIG. 3 is a top plan view of the rescue ramp shown in FIG. 1.
Figure 5:
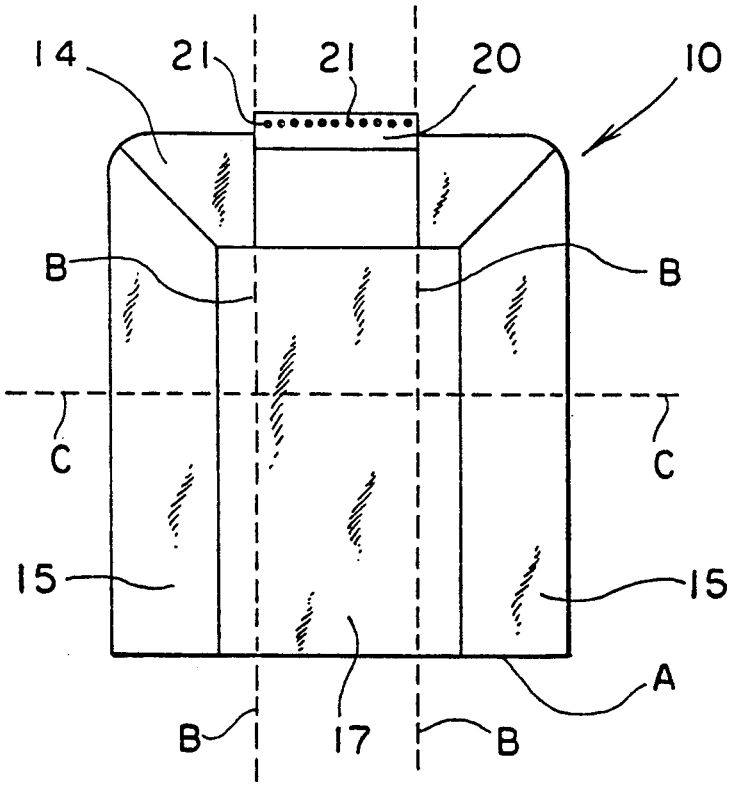
FIG. 5 is a schematic top plan representation depicting the manner in which an uninflated rescue ramp according to the concepts of the present invention can be folded for storage.

The outer ends of side tubes 15 can be provided with tabs 18 made of an eye and loop synthetic material which adhere to another similar material when pressed together, such as that sold under the trademark VELCRO. Complementary VELCRO tabs 19 are positioned at the inner side of tube 14 as shown in FIGS. 2 and 3. When rescue ramp 10 is not inflated, it can be folded and stored in craft 11 in a compact condition. The manner in which ramp 10 is folded is depicted in FIG. 5. There, ramp 10 is shown as already having been folded once, along line A, thus essentially dividing its length in half. As such, tubes 15 are folded generally centrally thereof and tabs 19 are attached to tabs 18 to maintain that condition. Then, the width of ramp 10, that is, of tube 14, is folded in thirds along lines B, so that tubes 15 are adjacent to each other. A final fold along line C renders ramp 10 compact for storing in a valise or other container on craft 11.

A fabric flap 20 is attached to the inner side of tube 14, generally centrally thereof, and is provided with a plurality of apertures 21 therein. Flap 20 is preferably of such a width such that when rescue ramp 10 is folded, as just described, it is folded to a width approximating flap 20 which is not at all folded. Flap 20, in a manner to be hereinafter described, is adapted to be attached to a girt bar assembly generally indicated by the numeral 22 and shown in FIGS. 2 and 3. Girt bar assembly 22 includes a girt bar 23 which can be attached to craft 11, at any desired location such as gunnel 13, as by providing brackets 24 extending outwardly therefrom. Since girt bar 23 is stored With ramp 10 when not in use, it is preferable that girt bar 23 be attachable to brackets 24 by any quick connect/disconnect type of attachment as would be well known to one skilled in the art.

Girt bar 23 is received within a loop 25 formed in one end of a fabric flap 26 which is part of girt bar assembly 22. The other end of flap 26 is provided with a plurality of apertures (not shown) which correspond to apertures 21 of flap 20 of ramp 10. Flap 26 may thereby be attached to flap 20 by any conventional quick disconnect method such as looping a string member through apertures 21 and the apertures formed in flap 26 in what is known as a "daisy-chain" type connection. Such a connection, or its equivalent, permits a quick disconnect feature such that, if necessary, the inflated ramp 10 can be disconnected from the girt bar assembly 22, and thus craft 11, during a rescue operation. Ramp 10 can itself then be used as a separate buoyancy platform, as may be desired.

Figure 4:
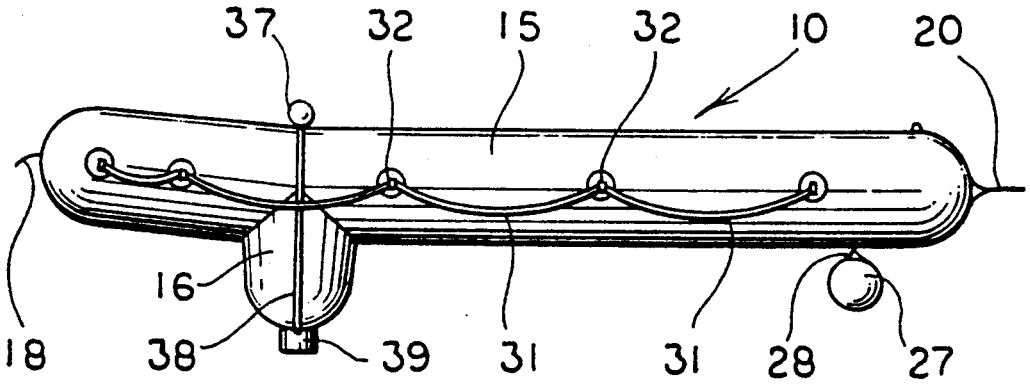
FIG. 4 is a side elevational view of the rescue ramp shown in FIG. 1.

In order to deploy ramp 10, it and the attached girt bar assembly are removed from the storage area on craft 11 and girt bar 23 is attached to its holding brackets 24. Then, with ramp 10 in its folded condition as previously described, it can be inflated. In this regard a canister 27 containing air or nitrogen charged to approximately 3000 psi can be conveniently carried in a fabric pouch 28 formed below and normally depending from tube 14 as shown in FIGS. 2 and 4. Ramp 10 can be therefore quickly inflated by removing canister 27 and attaching it to an inflation valve fitting 29 (FIG. 3) positioned in one tube 15 at a location such that it will be exposed when ramp 10 is folded. By thereby internally pressurizing tubes 14, 15 and 16, ramp 10 will unfold, with the unfolding process being somewhat controlled by the connection of VELCRO 18 to VELCRO 19; that is, this connection regulates the speed of, and the pressure required for, the unfolding as ramp 10 goes through the reverse of the folding steps described with respect to FIG. 5. When ramp 10 is sufficiently pressurized to overcome the VELCRO connection, tubes 15 unfold and ramp 10 is thus in the inflated, deployed condition shown in FIG. 1. At this time the typical internal pressure within tubes 14, 15 and 16 is preferably on the order of two and one-half psi. During use for any reason should it be desired or necessary to add air pressure internally of ramp 10, a topping-off valve 30 (FIG. 3) can be provided in tube 14 for that purpose.

A ramp 10, as just described, can thus be employed to rescue a person stranded in the water. To that end, if the person is conscious, he may merely walk or crawl up upon ramp fabric 17 and into craft 11 or, if necessary, someone on craft 11 can traverse down ramp fabric 17 and into the water to assist the stranded, and possibly injured or unconscious person.

In addition, rescue ramp 10 may be provided with other accessory-like items to assist the stranded person and otherwise make ramp 10 more readily usable. For example, life lines 31 may be sewn or tacked, as at 32, to the outside of tubes 15 so that if the stranded person is positioned at the side of rescue ramp 10, he may readily grab onto lines 31 and maneuver himself onto ramp fabric 17.

For additional assistance when getting onto or traversing ramp fabric 17, hand-hold assemblies 33, preferably made of a fabric material, may be positioned on the inside of the outer end of each tube 15, and additional hand-hold/foot-hold assemblies 34 may be attached to and spaced along ramp fabric 17. If the stranded person needs some assistance to get to ramp 10, a heaving line with a quoit at the end thereof can be positioned in a pouch 35 fabricated in one of the tubes 15 so that it is readily available to be thrown into the water toward the stranded person.

At times it may be desirable to attach rescue ramp 10 to another craft so that people on craft 11 could disembark from craft 11 to another. To that end, D-ring assemblies 36 (FIG. 1) can be mounted at the outer end of tubes 15. If it is desired to transport persons from craft 11 to another, the other craft may merely hook on to D-rings 36 and people can walk on a now generally horizontal ramp fabric 17 from one craft to another.

When operating at night, it is often desirable to illuminate ramp 10 with lane lights. For that purpose, at least one light 37 can be mounted on the top of each tube 15. A power wire 38 extending from each light 37 can be taped or otherwise adhered to the side of tubes 15, and a water activated battery 39 (FIG. 4) can be provided at the other end of each wire 38 and mounted on the bottom of tube 16. Thus, when in the water, batteries 39 will illuminate lights 37 to readily identify the location of rescue ramp 10.

It should thus be evident that an inflatable rescue ramp constructed in accordance with the concepts of the present invention, as described herein, and used as described herein, accomplishes the objects of the present invention and otherwise improves the art.

We claim:

1. A rescue ramp for a watercraft comprising a laterally extending first inflatable tube member, means to at least temporarily connect said first tube member to the watercraft, second spaced inflatable tube members having one end fluidly connected to said first tube member and extending generally longitudinally away from said first tube member, a third tube member fluidly connected between and below said second tube members near the other end thereof and adapted to be positioned in the water when said first tube member is connected to the watercraft, and ramp means connected to and between said first and second tube members, said ramp means being the only connection between said first and second tube members at said other end thereof so that a person may readily move onto said ramp means from the water and thereafter may traverse said ramp means from the water to the watercraft or from the watercraft to the water.

2. A rescue ramp according to claim 1 further comprising means to inflate said tube members.

3. A rescue ramp according to claim 2 wherein said means to inflate includes a pressurized canister carried by said first tube member.

4. A rescue ramp according to claim 3 wherein said means to inflate includes a valve positioned in at least one of said second tube members.

5. A rescue ramp according to claim 4 wherein said means to inflate includes an additional valve positioned in said first tube member to pressurize said tube members as necessary.

6. A rescue ramp according to claim 1 wherein said means to connect includes a bar member attachable to the watercraft and means to attach said bar member to said first tube member.

7. A rescue ramp according to claim 6 wherein said means to attach includes a first flap member carrying said bar member and a second flap member attached to said first tube member, said first and second flap members being detachably connectable to each other.

8. A rescue ramp according to claim 1 further comprising first attachment means positioned at said other end of said second tube members and second attachment means positioned on said first tube member, said second tube members being adapted to be folded generally longitudinally in half so that said first attachment means can engage said second attachment means.

9. A rescue ramp according to claim 8 wherein said means to connect includes a flap member generally centrally positioned along said first tube member, said first tube member being adapted to be folded such that it is of a lateral extent approximating the length of said flap member while at the same time positioning said second tube members adjacent to each other.

10. A rescue ramp according to claim 1 further comprising means positioned on said ramp means to assist the person traversing said ramp means.

11. A rescue ramp according to claim 1 wherein said tube members are constructed of a urethane coated nylon woven fabric.

12. A rescue ramp according to claim 1 further comprising life lines mounted on said second tube members on the sides thereof opposite said ramp means.

13. A rescue ramp according to claim 1 further comprising pouch means formed in at least one said second tube member to carry an accessory to assist the person to said ramp means.

14. A rescue ramp according to claim 1 further comprising means to illuminate said ramp means.

15. A rescue ramp according to claim 14 wherein said means to illuminate includes at least one light positioned on each said second tube member and a battery connected to each said light and positioned on said third tube member so as to be in contact with the water.

16. A rescue ramp for a watercraft comprising a laterally extending first inflatable tube member, means to at least temporarily connect said first tube member to the watercraft, second spaced inflatable tube members having one end connected to said first tube member and extending generally longitudinally away from said first tube member, a third tube member connected between said second tube members near the other end thereof and adapted to be positioned in the water when said first tube member is connected to the watercraft, ramp means connected to said first and second tube members, and means positioned on said ramp means including a plurality of hand/foot holds so that a person may be assisted in traversing said ramp means from the water to the watercraft or from the watercraft to the water.

17. A rescue ramp for a watercraft comprising a laterally extending first inflatable tube member, means to at least temporarily connect said first tube member to the watercraft, second spaced inflatable tube members having one end connected to said first tube member and extending generally longitudinally away from said first tube member, a third tube member connected between said second tube members near the other end thereof and adapted to be positioned in the water when said first tube member is connected to the watercraft, ramp means connected to said first and second tube members so that a person may traverse said ramp means from the water to the watercraft or from the watercraft to the water, and means positioned on said second tube members to assist the person to get on said ramp means.

18. A rescue ramp according to claim 17 wherein said means positioned on said second tube members includes a hand-hold mounted on each said second tube member near said other end thereof and above said ramp means.

19. A rescue ramp for a watercraft comprising a laterally extending first inflatable tube member, means to at least temporarily connect said first tube member to the watercraft, second spaced inflatable tube members having one end connected to said first tube member and extending generally longitudinally away from said first tube member, a third tube member connected between said second tube members near the other end thereof and adapted to be positioned in the water when said first tube member is connected to the watercraft, ramp means connected to said first and second tube members so that a person may traverse said ramp means from the water to the watercraft or from the watercraft to the water, and means on said second tube members to attach the rescue ramp to a second watercraft.

20. A rescue ramp according to claim 19 wherein said means on said second tube members includes a D-ring mounted at said other end of each said second tube member.

* * * * *